US008072198B2

(12) United States Patent
Imura

(10) Patent No.: US 8,072,198 B2
(45) Date of Patent: Dec. 6, 2011

(54) VOLTAGE REGULATOR

(75) Inventor: Takashi Imura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 163 days.

(21) Appl. No.: 12/703,454

(22) Filed: Feb. 10, 2010

(65) Prior Publication Data

US 2010/0201331 A1 Aug. 12, 2010

(30) Foreign Application Priority Data

Feb. 10, 2009 (JP) ..... 2009-028746
Jan. 12, 2010 (JP) ..... 2010-004412

(51) Int. Cl.
*G05F 1/571* (2006.01)
*G05F 1/618* (2006.01)

(52) U.S. Cl. ..... 323/276; 323/226; 323/274

(58) Field of Classification Search ..... 323/226, 323/273, 274, 275, 276, 277, 280, 281; 361/18, 361/91.1, 91.5
See application file for complete search history.

(56) References Cited

U.S. PATENT DOCUMENTS

| | | | | |
|---|---|---|---|---|
| 5,864,227 | A * | 1/1999 | Borden et al. | 323/280 |
| 6,201,375 | B1 * | 3/2001 | Larson et al. | 323/277 |
| 6,249,112 | B1 * | 6/2001 | Khouri et al. | 323/282 |
| 6,377,033 | B2 * | 4/2002 | Hsu | 323/274 |
| 7,221,213 | B2 * | 5/2007 | Lee et al. | 327/541 |
| 7,859,235 | B2 * | 12/2010 | Yamashita | 323/274 |
| 7,928,708 | B2 * | 4/2011 | Takada et al. | 323/274 |

FOREIGN PATENT DOCUMENTS

JP 2008-310616 A 12/2008

* cited by examiner

*Primary Examiner* — Gary L Laxton
(74) *Attorney, Agent, or Firm* — Brinks Hofer Gilson & Lione

(57) ABSTRACT

To provide a voltage regulator having improved response characteristics in case of overshoot. The voltage regulator includes: a transistor (303) for detecting an overshoot at an output terminal; and a current mirror circuit connected to the transistor (303). If the transistor (303) detects the overshoot, a control transistor (16) is turned ON to discharge a voltage of the output terminal.

6 Claims, 6 Drawing Sheets

VOLTAGE REGULATOR

RELATED APPLICATIONS

This application claims priority under 35 U.S.C. §119 to Japanese Patent Application Nos. 2009-028746 filed on Feb. 10, 2009 and 2010-004412 filed on Jan. 12, 2010, the entire contents of which are hereby incorporated by reference.

The present invention relates to a voltage regulator, in which an output terminal is connected to a load capacitor.

BACKGROUND OF THE INVENTION

1. Technical Field

A conventional voltage regulator is described. FIG. 6 is a circuit diagram illustrating the conventional voltage regulator.

2. Background Art

In general, an output section of a voltage regulator is connected to a capacitor in order to stabilize its regulating operation and improve its transient response characteristics. Also in this example, a load capacitor 95 is connected. A power supply unit 91 outputs a power supply voltage VDD. Based on the power supply voltage VDD, a voltage regulator 92 outputs an output voltage Vout which is a constant voltage. Based on the power supply voltage VDD, a voltage detection circuit 93 controls ON/OFF of an NMOS transistor 94.

If the power supply unit 91 shuts down, the power supply voltage VDD decreases, and the output voltage Vout decreases as well. When the power supply voltage VDD decreases to be lower than a predetermined voltage, the voltage detection circuit 93 controls the NMOS transistor 94 so that the NMOS transistor 94 may be turned ON, and then the NMOS transistor 94 is turned ON. Then, an output terminal of the voltage regulator 92 and a ground terminal is connected with each other, and hence the load capacitor 95 is forcedly discharged so that the output voltage Vout may decrease owing also to the NMOS transistor 94. In this case, the load capacitor 95 is discharged more rapidly with the NMOS transistor 94 than without the NMOS transistor 94 (see, for example, Patent Document 1).

Patent Document 1: JP 2000-152497 A

SUMMARY OF THE INVENTION

For example, if a load changes abruptly to a light load to cause an overshoot in the output voltage Vout, the output voltage Vout takes a longer time to be stable at a constant voltage, which results in deteriorated response characteristics of the voltage regulator. Therefore, in addition to conventional functions, an anti-overshoot function for reducing the time to improve the response characteristics has been sought after.

The present invention has been made in view of the problem describe above, and provides a voltage regulator having improved response characteristics in case of overshoot and capable of rapidly discharging a load capacitor at a time of shutdown.

The voltage regulator includes: a first transistor for detecting an overshoot at an output terminal; a second transistor having a gate and a drain which are connected to a drain of the first transistor; a third transistor having a gate connected to the gate of the second transistor; and a fourth transistor having a drain connected to a drain of the third transistor, and a gate connected to a reference voltage terminal, the fourth transistor having a threshold lower than a threshold of the first transistor.

According to the present invention, if an output voltage of the voltage regulator becomes higher than a detection voltage, a control transistor is turned ON to discharge the load capacitor. Accordingly, the output voltage of the voltage regulator abruptly decreases, and hence the output voltage of the voltage regulator takes a shorter time to be stable at a constant voltage after exceeding the detection voltage, which results in improved response characteristics of the voltage regulator. Therefore, even if a load changes abruptly to a light load to cause an overshoot in the output voltage, and the output voltage accordingly becomes higher than the detection voltage, the improved response characteristics of the voltage regulator are maintained.

Further, also upon input of an external signal input from an outside at the time of shutdown, the control transistor is turned ON to discharge the load capacitor. Therefore, the load capacitor may be discharged rapidly at the time of shutdown so that the output voltage of the voltage regulator may be controlled to a ground voltage swiftly.

DETAILED DESCRIPTION OF THE PREFERRED EMBODIMENTS

Figure 1:
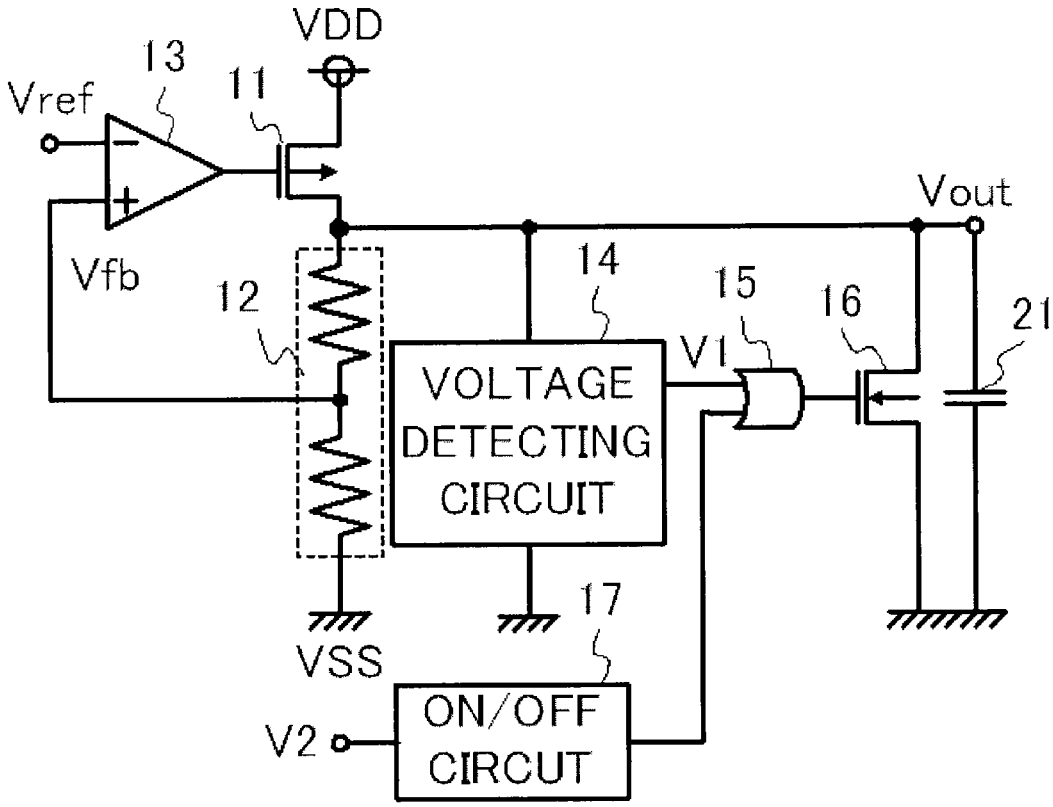
[FIG. 1] A circuit diagram illustrating a voltage regulator according to the present invention.

FIG. 1 is a circuit diagram illustrating a voltage regulator according to the present invention.

The voltage regulator includes an output transistor 11, a voltage dividing circuit 12, an amplifier 13, a voltage detection circuit 14, an OR circuit 15, a control transistor 16, and an ON/OFF circuit 17. Further, an output terminal of the voltage regulator is connected to a load capacitor 21.

The output transistor 11 has a gate connected to an output terminal of the amplifier 13, a source connected to a power supply terminal, and a drain connected to a ground terminal via the voltage dividing circuit 12. The amplifier 13 has a non-inverting input terminal connected to an output terminal of the voltage dividing circuit 12, and an inverting input terminal connected to a reference voltage input terminal.

The voltage detection circuit 14 has an input terminal connected to the output terminal of the voltage regulator, and an output terminal connected to a first input terminal of the OR circuit 15. The ON/OFF circuit 17 has an input terminal connected to an ON/OFF control terminal V2 of the voltage regulator, and an output terminal connected to a second input terminal of the OR circuit 15. The control transistor 16 has a gate connected to an output terminal of the OR circuit 15, a source connected to the ground terminal, and a drain connected to the output terminal of the voltage regulator. Further, the load capacitor 21 is provided between the output terminal of the voltage regulator and the ground terminal.

The output transistor 11 outputs an output voltage Vout based on an output voltage of the amplifier 13 and a power supply voltage VDD. The voltage dividing circuit 12 divides the output voltage Vout to output a divided voltage Vfb. The amplifier 13 makes a comparison between the divided voltage Vfb and a reference voltage Vref, and controls the output transistor 11 so that the output voltage Vout may become a constant voltage.

A detection voltage higher than the above-mentioned constant voltage is set in the voltage detection circuit 14, and the voltage detection circuit 14 outputs a detection signal when detecting that the output voltage Vout has become higher than the detection voltage. The ON/OFF circuit 17 is a circuit for inputting an external signal which is input from an outside at the time of shutdown and outputting a signal for shutting down each component circuit, and has hysteresis characteristics with respect to the external signal for the purpose of taking measures against chattering and noise. When inputting the detection signal or the external signal, the OR circuit 15 turns ON the control transistor 16. The control transistor 16 discharges the load capacitor 21 by being turned ON.

Next, an operation of the voltage regulator is described.

When the output voltage Vout is higher than a predetermined voltage, that is, when the divided voltage Vfb is higher than the reference voltage Vref, the output voltage of the amplifier 13 (gate voltage of the output transistor 11) is so high that the output transistor 11 may approach an OFF state. Then, the output voltage Vout decreases. On the other hand, when the output voltage Vout is lower than the predetermined voltage, in a similar way to the above, the output voltage Vout increases. Thus, the output voltage Vout becomes constant.

If a load changes abruptly to a light load, an overshoot may occur in the output voltage Vout. In this case, the output voltage Vout is higher than the detection voltage.

When the output voltage Vout becomes higher than the detection voltage, an output voltage V1 becomes High. In other words, the voltage detection circuit 14 outputs the detection signal. Then, an output voltage of the OR circuit 15 also becomes High, and the control transistor 16 is turned ON to discharge the capacitor 21. Then, the output voltage Vout abruptly decreases, and hence the output voltage Vout takes a shorter time to be stable at a constant voltage after exceeding the detection voltage, which results in improved response characteristics of the voltage regulator.

If temperature increases to increase a leakage current of the output transistor 11, the output voltage Vout may become higher than the detection voltage.

When the output voltage Vout becomes higher than the detection voltage, the output voltage V1 becomes High. In other words, the voltage detection circuit 14 outputs the detection signal. Then, the output voltage of the OR circuit 15 also becomes High, and the control transistor 16 is turned ON to discharge the capacitor 21. Then, the output voltage Vout abruptly decreases, and hence the output voltage Vout is less likely to reach the detection voltage or higher. As a result, an increase in output voltage Vout to reach the detection voltage or higher may be suppressed.

If the output voltage Vout increases again thereafter due to the leakage current, the output voltage Vout decreases again in a similar way to the above so that the capacitor 21 may be discharged intermittently.

At the time of shutdown, external control is performed on the voltage regulator so that an input voltage of the ON/OFF control terminal V2 may become High. The output voltage of the OR circuit 15 becomes High, and the control transistor 16 is turned ON to discharge the capacitor 21. Accordingly, the load capacitor 21 may be discharged rapidly at the time of shutdown.

Now, referring to the drawings, detailed embodiments of the voltage regulator according to the present invention are described below.

First Embodiment

Figure 2:
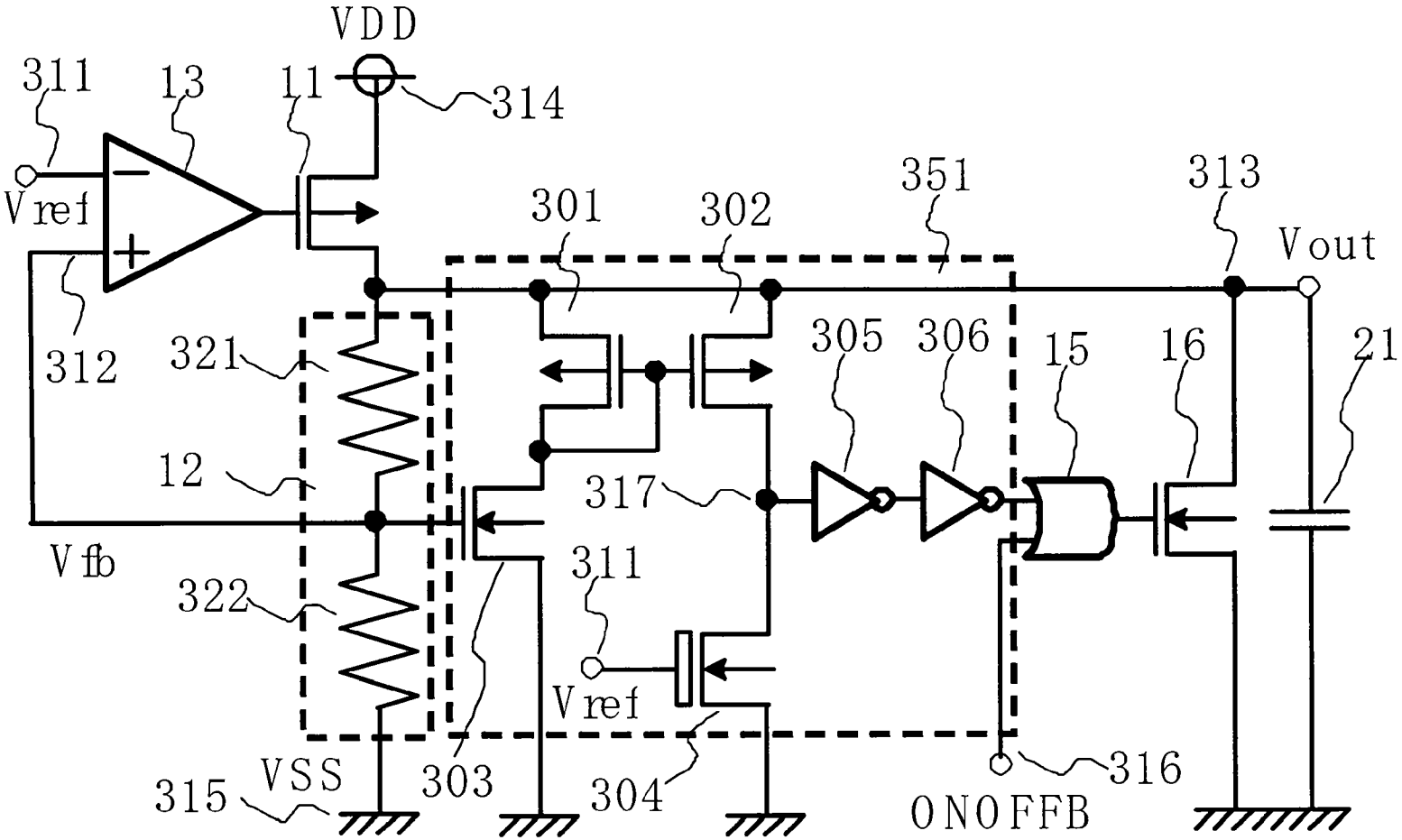
[FIG. 2] A circuit diagram illustrating a voltage regulator according to a first embodiment.

FIG. 2 is a circuit diagram of a voltage regulator according to a first embodiment.

The voltage regulator according to the first embodiment includes an output transistor 11, a voltage dividing circuit 12, an amplifier 13, a voltage detection circuit section 351, an OR circuit 15, and a control transistor 16. The voltage dividing circuit 12 includes a resistor 321 and a resistor 322. The voltage detection circuit section 321 includes a PMOS transistor 301, a PMOS transistor 302, an NMOS transistor 303, an NMOS transistor 304, an inverter 305, and an inverter 306.

The amplifier 13 has an output connected to a gate of the output transistor 11, a non-inverting input terminal connected to a node 312, and an inverting input terminal connected to a node 311. The output transistor 11 has a drain connected to an output terminal 313, and a source connected to a power supply terminal 314. The voltage dividing circuit 12 has one terminal connected to the output terminal 313, and another terminal connected to a ground terminal 315. The voltage dividing circuit 12 has an output connected to the node 312 and a gate of the NMOS transistor 303 included in the voltage detection circuit section 321. The voltage detection circuit section 321 has an output connected to the OR circuit 15. The OR circuit 15 has one input terminal connected to the output of the voltage detection circuit section 321, and another input terminal connected to an ONOFFB terminal 316. The OR circuit 15 has an output connected to a gate of the control transistor 16. The control transistor 16 has a source connected to the ground terminal 315, and a drain connected to the output terminal 313.

In the voltage dividing circuit 12, a connection point between the resistor 321 and the resistor 322 is connected to the node 312, another terminal of the resistor 321 is connected to the output terminal 313, and another terminal of the resistor 322 is connected to the ground terminal 315.

In the voltage detection circuit section 351, a drain of the NMOS transistor 303 is connected to a drain and a gate of the PMOS transistor 301 and a gate of the PMOS transistor 302, and a source of the NMOS transistor 303 is connected to the ground terminal 315. The PMOS transistor 301 has a source connected to the output terminal 313. The PMOS transistor 302 has a drain connected to an input terminal of the inverter 305 and a drain of the NMOS transistor 304. The PMOS transistor 302 has a source connected to the output terminal 313. The NMOS transistor 304 has a gate connected to a reference voltage terminal 311, and a source connected to the ground terminal 315. The inverter 306 has an input connected to an output terminal of the inverter 305, and an output connected to the input terminal of the OR circuit 15.

Next, an operation of the voltage regulator is described.

In a normal operation state in which a signal of Low is input to the ONOFFB terminal 316, the NMOS transistor 304 is turned ON so that a node 317 may become Low. Then, the output of the OR circuit 15 becomes Low to turn OFF the control transistor 16 so that control on the voltage Vout of the output terminal 313 may be disabled.

If a load connected to the output terminal 313 changes abruptly from a heavy load to a light load, an overshoot occurs in the voltage Vout of the output terminal 313. Then, the voltage of the node 317 instantaneously becomes High due to a parasitic capacitance between the drain and the source of the PMOS transistor 302. Then, the output of the OR circuit 15 becomes High to turn ON the control transistor 16. In this way, the voltage of the output terminal 313 is caused to reduce to thereby suppress the overshoot. After that, the overshoot occurs similarly in a voltage of the node 312, and then the NMOS transistor 303 detects the overshoot to be turned ON so that a current may start to flow through the PMOS transistor 301. The PMOS transistors 301 and 302 have a current mirror configuration, and hence a current also flows through the PMOS transistor 302 so that the node 317 may become High. Then, the output of the OR circuit 15 becomes High to turn ON the control transistor 16. In this way, the voltage of the output terminal 313 is caused to reduce to thereby suppress the overshoot.

In the voltage detection circuit section 351 configured as described above, immediately after an overshoot has occurred in the voltage Vout, the control transistor 16 is turned ON instantly due to the parasitic capacitance between the drain and the source of the PMOS transistor 302 so as to decrease the voltage Vout, and after that, until the overshoot may be reduced, the NMOS transistor 303 detects the overshoot to thereby turn ON the control transistor 16 so as to decrease the voltage Vout. As to the NMOS transistor 303 and the NMOS transistor 304, the NMOS transistor 304 is set to have a threshold lower than a threshold of the NMOS transistor 303. The threshold difference corresponds to the detection voltage at which the overshoot is detected, and hence the voltage Vout may be decreased by the NMOS 303 being turned ON only when the voltage of the node 312 increases to the threshold difference or higher after the overshoot has occurred. Note that although not illustrated, each source of the PMOS transistor 301 and the PMOS transistor 302 may be connected to the power supply terminal 314.

As described above, according to the voltage regulator of the first embodiment, if an overshoot occurs at the output terminal 313, the control transistor 16 is turned ON to thereby suppress the overshoot.

Second Embodiment

Figure 3:
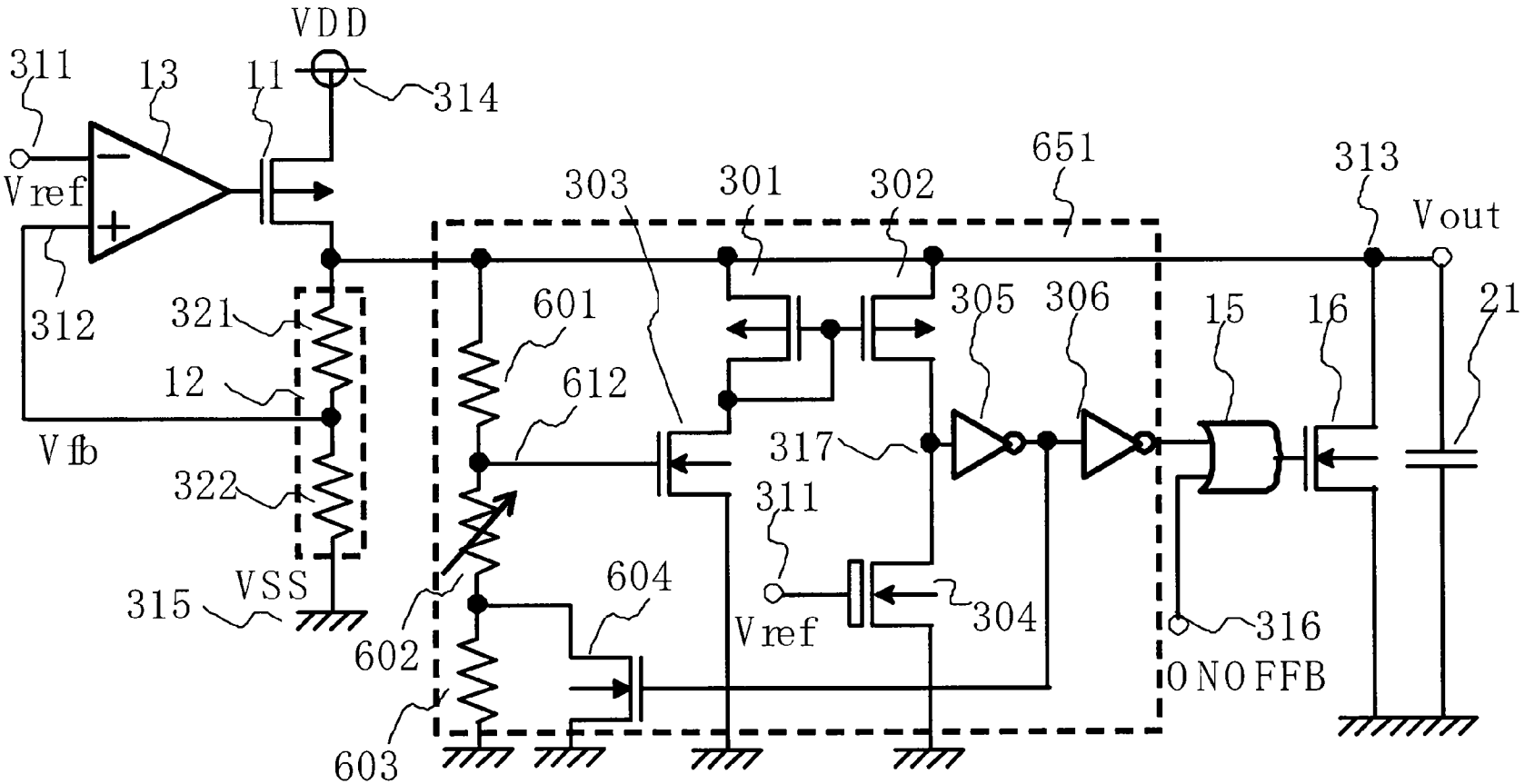
[FIG. 3] A circuit diagram illustrating a voltage regulator according to a second embodiment.

FIG. 3 is a circuit diagram of a voltage regulator according to a second embodiment.

A difference from FIG. 2 resides in that resistors 601, 602, and 603 are used to set a detection voltage for overshoot, and that an NMOS transistor 604 is used to provide hysteresis to a release voltage. Connection is made such that a connection point between the resistor 601 and the resistor 602 is connected to the gate of the NMOS transistor 303, and another terminal of the resistor 601 is connected to the output terminal 313. A connection point between the resistor 602 and the resistor 603 is connected to a drain of the NMOS transistor 604, and another terminal of the resistor 603 is connected to the ground terminal 315. The NMOS transistor 604 has a gate connected to an output of the inverter 305, and a source connected to the ground terminal 315.

Next, an operation of the voltage regulator according to the second embodiment is described.

If an overshoot occurs in the voltage Vout of the output terminal 313, the overshoot occurs similarly in a voltage of a node 612. Then, the NMOS transistor 303 detects the overshoot to be turned ON so that a current may start to flow through the PMOS transistor 301. The PMOS transistors 301 and 302 have a current mirror configuration, and hence a current also flows through the PMOS transistor 302 so that the node 317 may become High. Then, the output of the OR circuit 15 becomes High to turn ON the control transistor 16. In this way, the voltage of the output terminal 313 is caused to reduce to thereby suppress the overshoot. The voltage at which the overshoot is detected is determined based on a ratio of the resistors 601, 602, and 603. Therefore, by adjusting the ratio, the detection voltage may be adjusted arbitrarily. Besides, although not illustrated, if the resistors 601, 602, and 603 are allowed to be trimmed, fine adjustment may be performed taking process fluctuations into consideration.

If the overshoot occurs at the output terminal 313, the node 317 becomes High to turn ON the control transistor 16 so that the overshoot at the output terminal 313 starts to reduce. When the overshoot is reducing thereafter, because the output of the inverter 305 is Low, the NMOS transistor 604 is turned OFF to change the resistance ratio, to thereby lower the release voltage. As a result, the NMOS transistor 303 may be turned OFF at the release voltage lower than the detection voltage so that the voltage of the node 317 may be inverted from High to Low to turn OFF the control transistor 16. The difference is provided between the detection voltage and release voltage of the node 312 as described above, and hence the control transistor 16 is prevented from being repeatedly turned ON/OFF around the detection voltage to cause noise. Note that although not illustrated, each source of the PMOS transistor 301 and the PMOS transistor 302 may be connected to the power supply terminal 314.

As described above, according to the voltage regulator of the second embodiment, if an overshoot occurs at the output terminal 313, the control transistor 16 is turned ON to thereby suppress the overshoot. Besides, the detection voltage and release voltage for overshoot may be adjusted arbitrarily by means of the resistors, and the hysteresis may be utilized for turning ON/OFF the control transistor 16 to thereby prevent noise from occurring.

Third Embodiment

Figure 4:
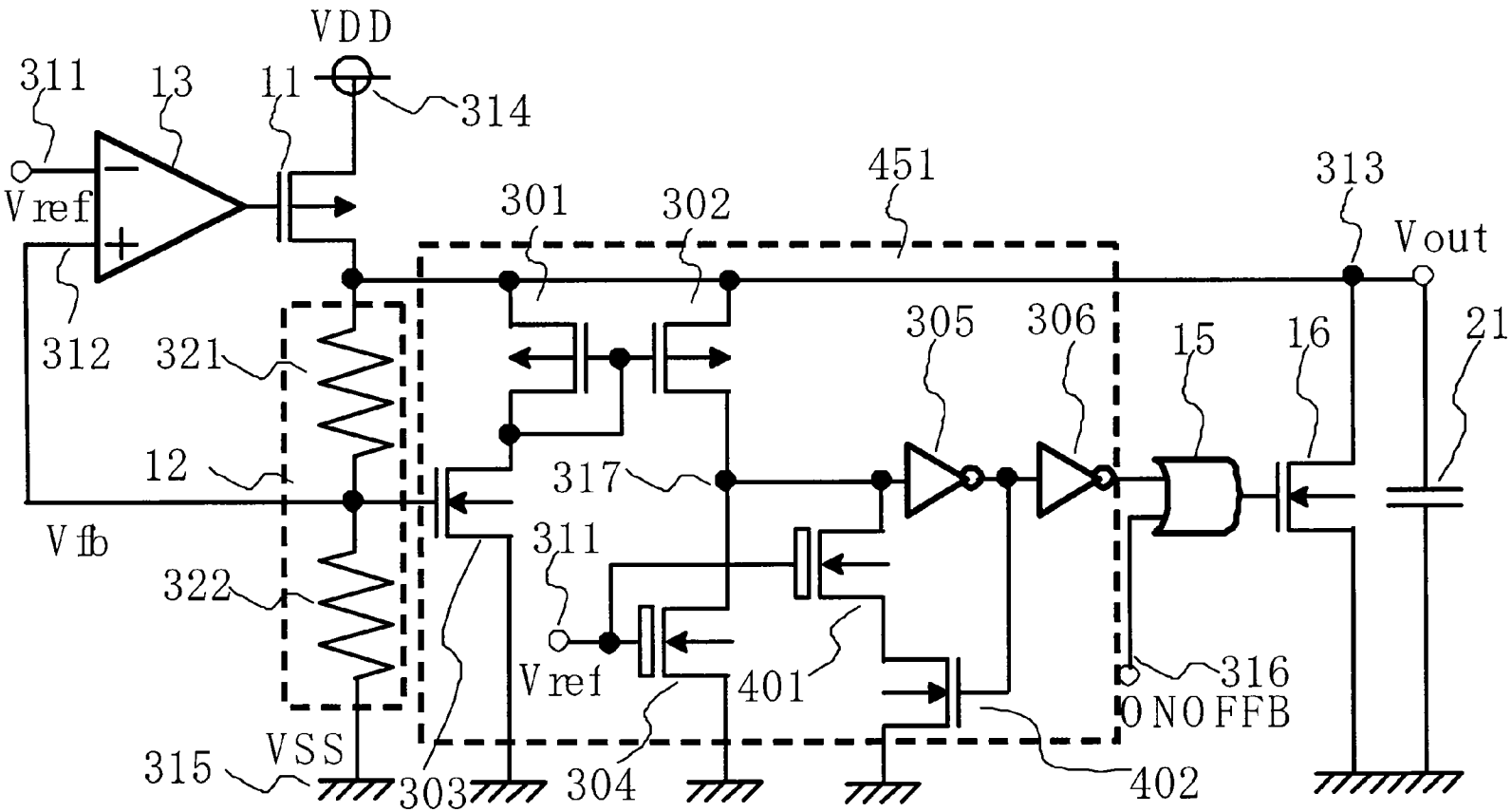
[FIG. 4] A circuit diagram illustrating a voltage regulator according to a third embodiment.

FIG. 4 is a circuit diagram of a voltage regulator according to a third embodiment.

A difference from FIG. 2 resides in that an NMOS transistor 401 and an NMOS transistor 402 are added so as to provide hysteresis to the detection voltage and release voltage for overshoot. Connection is made such that a gate of the NMOS transistor 401 is connected to the node 311, a drain thereof is connected to the node 317, and a source thereof is connected to a drain of the NMOS transistor 402. The NMOS transistor 402 has a gate connected to the output of the inverter 305, and a source connected to the ground terminal 315.

Next, an operation of the voltage regulator according to the third embodiment is described.

If the overshoot occurs at the output terminal 313, the node 317 becomes High to turn ON the control transistor 16 so that the overshoot at the output terminal 313 starts to reduce. When the overshoot is reducing thereafter, because the output of the inverter 305 is Low, the NMOS transistor 604 is turned OFF, to thereby lower an invert level of the node 317. This corresponds to the decrease in release voltage of the node 312. Then, when the overshoot reduces to decrease the voltage of the node 312, the NMOS transistor 303 is turned OFF at the release voltage lower than the detection voltage of the node 312 so that the voltage of the node 317 may be inverted from High to Low to turn OFF the control transistor 16. The difference is provided between the detection voltage and release voltage of the node 312 as described above, and hence the control transistor 16 is prevented from being repeatedly turned ON/OFF around the detection voltage to cause noise. Note that although not illustrated, each source of the PMOS transistor 301 and the PMOS transistor 302 may be connected to the power supply terminal 314.

As described above, according to the voltage regulator of the third embodiment, if an overshoot occurs at the output terminal 313, the control transistor 16 is turned ON to thereby suppress the overshoot. Besides, to the detection voltage and release voltage for overshoot, the hysteresis may be utilized for turning ON/OFF the control transistor 16 to thereby prevent noise from occurring.

Fourth Embodiment

Figure 5:
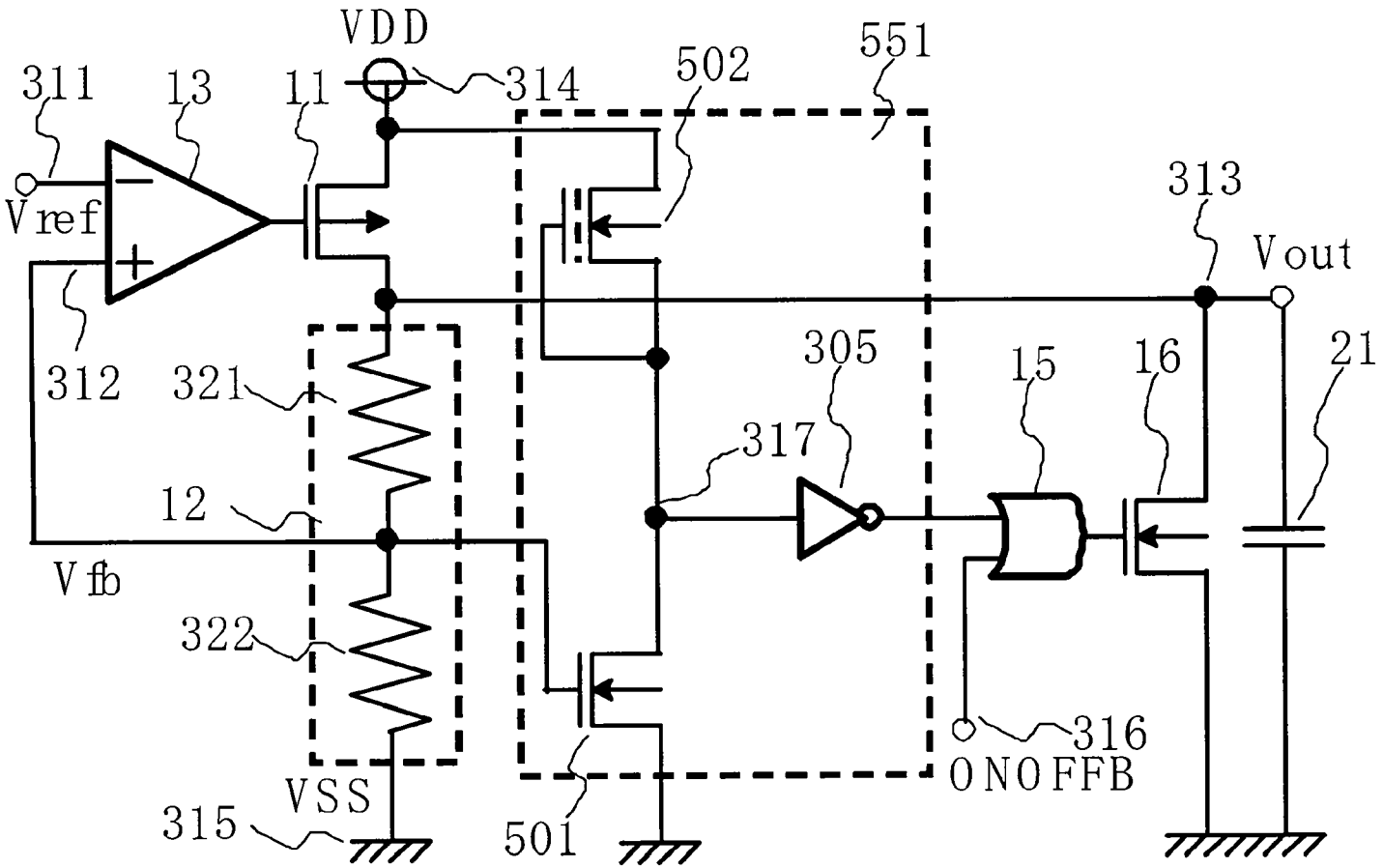
[FIG. 5] A circuit diagram illustrating a voltage regulator according to a fourth embodiment.
Figure 6:
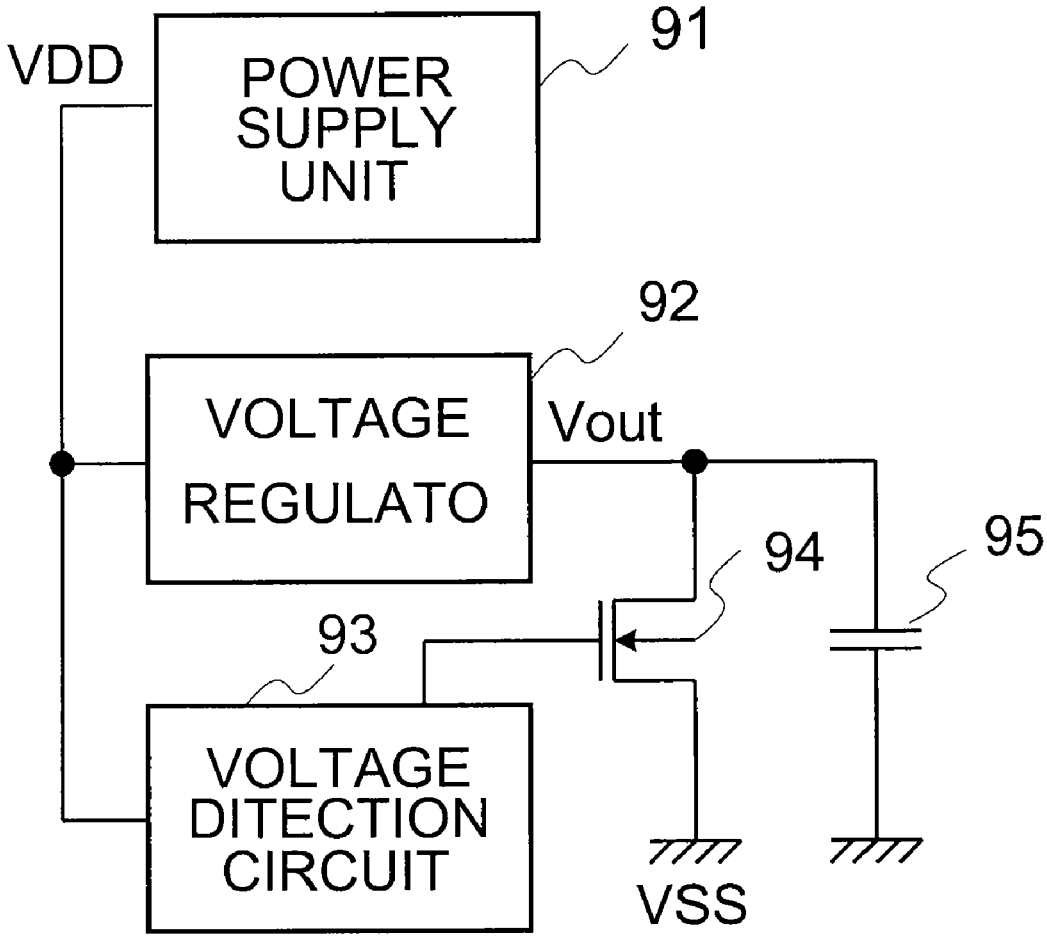
Fig.6 (PRIOR ART)
[FIG. 6] A circuit diagram illustrating a conventional voltage regulator.

FIG. 5 is a circuit diagram of a voltage regulator according to a fourth embodiment.

A difference from FIG. 2 resides in that an N-channel depletion transistor 502 and an NMOS transistor 501 are used to detect an overshoot in the output voltage. Connection is made such that a gate of the NMOS transistor 501 is connected to the node 312, a drain thereof is connected to the node 317, and a source thereof is connected to the ground terminal 315. The N-channel depletion transistor 502 has a gate and a source which are connected to the node 317, and a drain connected to the power supply terminal 314.

Next, an operation of the voltage regulator according to the fourth embodiment is described.

In a normal operation state in which a signal of Low is input to the ONOFFB terminal 316, the NMOS transistor 504 is turned OFF so that the node 317 may become High. Then, the output of the OR circuit 15 becomes Low to turn OFF the control transistor 16 so that control on the voltage Vout of the output terminal 313 may be disabled.

If the load connected to the output terminal 313 changes abruptly from a heavy load to a light load, an overshoot occurs in the voltage Vout of the output terminal 313. Then, the overshoot occurs similarly in the voltage of the node 312, and the NMOS transistor 501 detects the overshoot to be turned ON. When the NMOS transistor 501 is turned ON, the node 317 becomes Low, and the output of the OR circuit 15 becomes High to turn ON the control transistor 16. In this way, the voltage of the output terminal 313 is caused to reduce to thereby suppress the overshoot.

As described above, according to the voltage regulator of the fourth embodiment, if an overshoot occurs at the output terminal 313, the control transistor 16 is turned ON to thereby suppress the overshoot. Besides, the number of transistors in use may be reduced, resulting in a reduced layout area.

What is claimed is:

1. A voltage regulator, in which an output terminal is connected to a load capacitor, and a voltage detection circuit section for detecting an overshoot at the output terminal controls a control transistor connected to the output terminal so as to suppress the overshoot at the output terminal, wherein the voltage detection circuit section comprises:

a first transistor for detecting the overshoot at the output terminal;

a second transistor having a gate and a drain which are connected to a drain of the first transistor, and a source connected to the output terminal;

a third transistor having a gate connected to the gate of the second transistor, and a source connected to the output terminal; and a fourth transistor having a drain connected to a drain of the third transistor, and a gate connected to a reference voltage terminal, the fourth transistor having a threshold lower than a threshold of the first transistor, and wherein the overshoot at the output terminal is detected by a parasitic capacitance between the drain and the source of the third transistor before the first transistor detects the overshoot at the output terminal.

2. A voltage regulator according to claim 1, wherein a connection point between a first resistor connected to the output terminal and a second resistor is connected to a gate of the first transistor.

3. A voltage regulator according to claim 2, wherein the second resistor comprises a plurality of resistors, and wherein the voltage regulator further comprises a fifth transistor for switching a resistance value of the second resistor in accordance with an output of the voltage detection circuit section.

4. A voltage regulator according to claim 1, wherein the voltage detection circuit section further comprises:

a fifth transistor having a drain connected to the drain of the third transistor, and a gate connected to the reference voltage terminal, the fifth transistor having a threshold lower than the threshold of the first transistor; and a sixth transistor having a drain connected to a source of the fifth transistor.

5. A voltage regulator according to claim 2, wherein the voltage detection circuit section further comprises:

a fifth transistor having a drain connected to the drain of the third transistor, and a gate connected to the reference voltage terminal, the fifth transistor having a threshold lower than the threshold of the first transistor; and a sixth transistor having a drain connected to a source of the fifth transistor.

6. A voltage regulator according to claim 3, wherein the voltage detection circuit section further comprises:

a fifth transistor having a drain connected to the drain of the third transistor, and a gate connected to the reference voltage terminal, the fifth transistor having a threshold lower than the threshold of the first transistor; and a sixth transistor having a drain connected to a source of the fifth transistor.

* * * * *